United States Patent [19]

Hedlund et al.

[11] Patent Number: 4,921,310

[45] Date of Patent: May 1, 1990

[54] TOOL FOR BREAKING, CUTTING OR WORKING OF SOLID MATERIALS

[76] Inventors: Jan-Gunnar Hedlund, N. Ronngatan 16, S-811 35 Sandviken; Lennart Hansson, Algstigen 19; Hans-Olay Norman, Starrvagen 3, both of S-952 00 Kalix, all of Sweden

[21] Appl. No.: 205,634

[22] Filed: Jun. 13, 1988

[30] Foreign Application Priority Data

Jun. 12, 1987 [SE] Sweden ..... 8702443

[51] Int. Cl.[5] ..... E21C 35/18

[52] U.S. Cl. ..... 299/92; 299/86

[58] Field of Search ..... 299/79, 86, 91, 92, 299/93

[56] References Cited

U.S. PATENT DOCUMENTS

| | | | |
|---|---|---|---|
| 3,519,309 | 7/1970 | Engle et al. | 299/86 |
| 4,201,421 | 5/1980 | Den Besten et al. | 299/92 X |
| 4,684,176 | 8/1987 | Den Besten et al. | 299/91 |
| 4,728,153 | 3/1988 | Ojanen et al. | 299/92 |
| 4,836,614 | 6/1989 | Ojanen | 299/92 |
| 4,850,649 | 7/1989 | Beach et al. | 299/86 X |

*Primary Examiner*—Jerome W. Massie, IV
*Assistant Examiner*—David J. Bagnell
*Attorney, Agent, or Firm*—Burns, Doane, Swecker & Mathis

[57] ABSTRACT

A tool for breaking, cutting, and working solid materials includes a rearwardly extending shaft adapted to be inserted into the bore of a holder. The shaft includes an annular groove located adjacent a rearmost end thereof. A cylindrical clip is mounted on the shaft for retaining the tool within the holder. The clip includes a longitudinal slot extending longitudinally completely therethrough. A rear free end of the clip is inwardly bent into the groove of the shaft to oppose longitudinal forward movement of the shaft relative to the clip.

6 Claims, 3 Drawing Sheets

TOOL FOR BREAKING, CUTTING OR WORKING OF SOLID MATERIALS

BACKGROUND AND OBJECTS OF THE INVENTION

The present invention refers to a tool for breaking, cutting or working of solid materials, said tool being intended to be rotatably mounted in a holder and being provided with a hard material cutting insert and a generally cylindrical shaft that is intended to be received in the holder, and that a clip is mounted on the shaft, the clip being generally cylindrical and having a slot that extends between the ends of the clip, and that the shaft has a tangentially extending groove.

In the tools of the type mentioned above two types of so-called clips are previously known.

The first type is usually called "dog-collar" and is, e.g., disclosed in U.S. Pat. No. 3,519,309. This type of clip has an axial extension that is only about half the length of the shaft, the whole of the clip being received in a groove on the shaft of the tool, the groove usually being located closer to the free end of the shaft than to the cutting end thereof. In mounted position the clip lies flush with the shaft on both sides of the groove. This means that an essential portion of the shaft has a direct contact with the recess in the holder that receives the tool. Such an arrangement causes a strong wearing both of the shaft and the holder upon rotation of the tool.

The other type of clip, called "long sleeve" extends along substantially the whole length of the shaft. At the free end of the shaft a collar is provided that constitutes a land surface for the clip and thus prevents axial displacement of the tool relative to the clip. When the tool is mounted in its holder the collar is flush to the clip. This means that there is a direct contact between the collar and the holder. This arrangement gives rise to a strong wearing of collar and holder already at a small inclination of the tool due to the cutting forces.

The aim of the present invention is to disclose a tool of the type mentioned above, the tool thus eliminating the shortcomings mentioned above by avoiding a direct contact between the shaft and the holder. Also a facilitated mounting of the tool is achieved.

BRIEF DESCRIPTION OF THE DRAWINGS

Below embodiments of the invention will be described, reference being made to the enclosed drawings where.

DETAILED DESCRIPTION OF PREFERRED EMBODIMENTS OF THE INVENTION

Figure 1A:
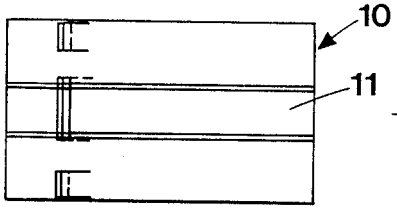
FIG. 1A shows a side view of a clip according to the invention.
Figure 1B:
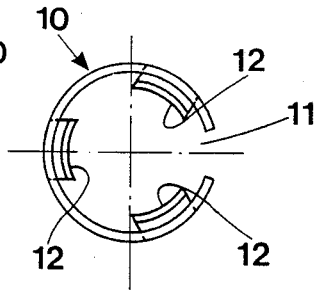
FIG. 1B shows an end view of a clip according to the invention.

The clip 10 of FIGS. 1A and 1B, in the shape of a sleeve having a slot 11, is generally seen cylinderical. The slot 11 runs in the axial direction of the sleeve and extends along the entire length of the sleeve.

In the disclosed embodiment the slot 11 has a tangential extension that is 1/10 of the entire circumference of the clip 10.

The clip 10 is provided with a number of inwardly bent tongues 12 that are stamped from the clip 10. In the disclosed embodiment the tongues 12 are situated on the same level seen in axial direction and displaced towards one end of the clip. The free ends of the tongues 12 are directed from the longitudinal center of the clip. Within the scope of the invention it is also possible to have the free ends of the tongues directed in the opposite direction.

Figure 2:
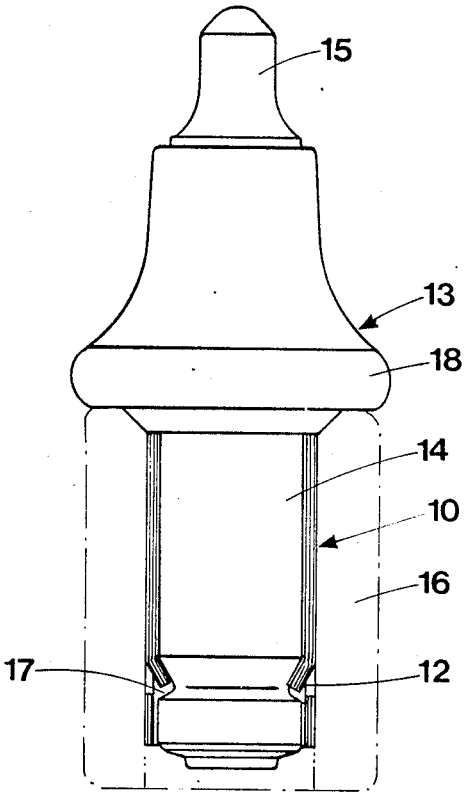
FIG. 2 shows the clip according to FIG. 1 in mounted position.

In FIG. 2 the clip is shown in a mounted position surrounding the shaft 14 of a tool 13 for breaking solid materials, the tool 13 having a hard material cutting insert 15. The shaft 14 has a generally seen cylindrical shape. The clip 10 is in its turn received in a tool holder 16 that is only indicated in FIG. 2.

As can be seen from FIG. 2, the clip 10 extends along the entire length of the shaft 14, the tongues 12 being in engagement with a tangential groove 17 in the shaft 14. The purpose of the tongues 12 is thus to anchor the shaft 14 in an axial direction relative to the clip 10. In reality this means that the shaft is releasably anchored relative to the holder 16 since the clip 10 clamps against the holder 16.

In this connection it should be noted that the orientation of the tongues 12 disclosed in FIG. 2 provides an extremely safe anchoring of the tool against ejection out of the holder 16. The diameter of the shaft 14 is essentially the same on both sides of the groove 17.

From FIG. 2 it is apparent that a direct contact between the shaft 14 and the holder 16 is not possible. The only direct contact between the tool 13 and the holder 16 is via flange 18 of the tool 13.

The clips 10 are manufactured from spring steel and in connection therewith it is so arranged that the diameter of the clips is somewhat larger than the diameter of the recess in the holder 16. This means that after mounting of the shaft 14 of the tool 13, including the clip 10, in the holder 16 the clip 10 will clamp against the holder 16 and consequently the shaft 14 of the tool 13 will rotate relative to the clip 10.

Figure 3:
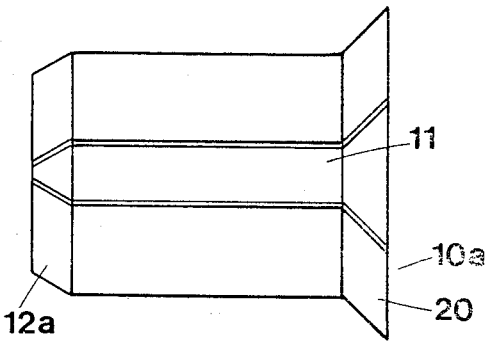
FIG. 3 shows an alternative embodiment of a clip according to the invention.

In the embodiment disclosed in FIG. 3 the clip **10*a* is provided with an outwardly extending conical collar 20 at one end of the clip 10*a* and an inwardly extending conical portion 12*a* at the other end of the clip 10*a*. A slot 11 extends in axial direction along the entire length of the clip 10*a***.

Figure 4:
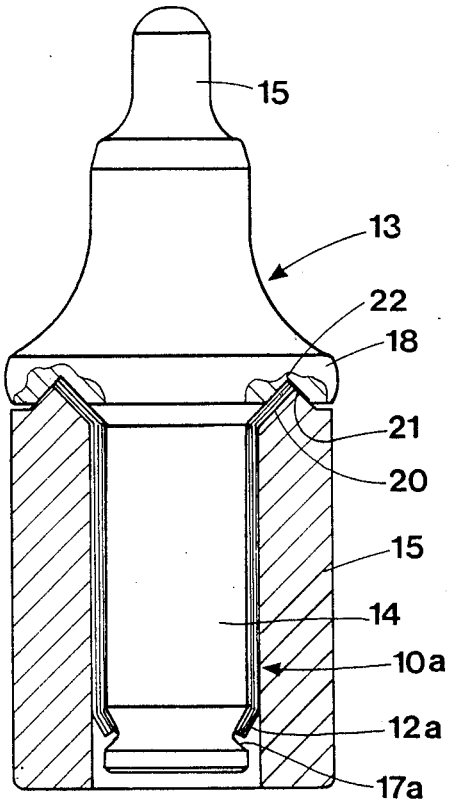
FIG. 4 shows the clip according to FIG. 3 in a mounted position.

As can be seen from FIG. 4 the collar 20 extends along the inner side of a pointed, circumferentially extending, projection 21 on the holder 16. The projection 21 with the collar 20 cooperates with a circumferentially extending groove 22 of a corresponding shape on the lower side of the flange 18 of the tool 13. The projection 21 and the groove 22 cooperate in order to prevent dirt and other unwanted particles from penetrating between the shaft 14 and the holder 16.

The free end of the portion 12*a* cooperates with a groove 17 on the shaft 14 of the tool 13.

The portions of the shaft 14 on both sides of the groove 17 have essentially the same diameter. Unlike the embodiment according to FIGS. 1 and 2 the clip 10*a* does not extend past the groove 17 but rather the free end of the portion 12*a* terminates in the groove 17. The groove 17 is located so close to the free end of the shaft 14 that the risk for contact between said end and the holder 16 in reality has been eliminated.

By the disclosed design of the portion 12*a* of the clip 10*a* it is immediately realized that the mounting of the tool 13 is facilitated by the fact that the portion 12*a* guides the shaft 14 into the holder 16.

Figure 6:
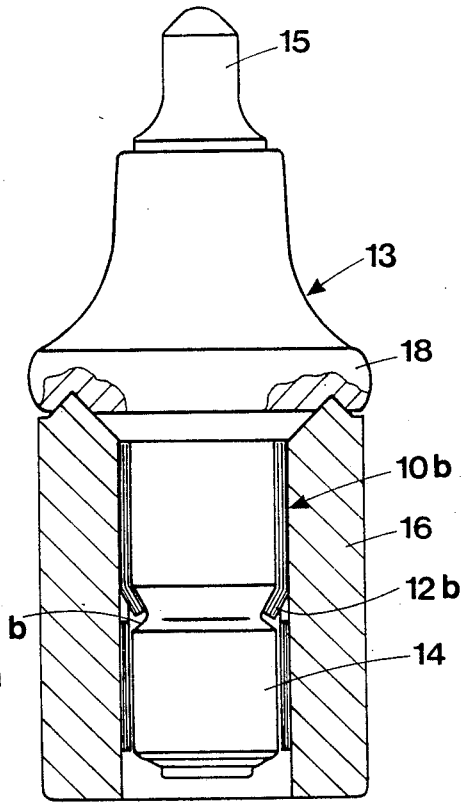
FIG. 6 shows the clip according to FIG. 5 in a mounted position.
Figure 5A:
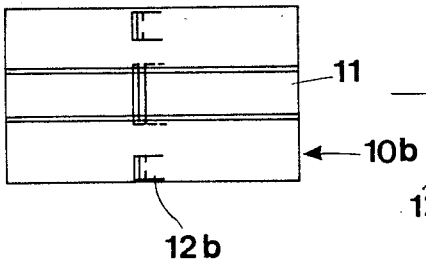
FIG. 5A shows a side view of a further alternative embodiment of a clip according to the invention.
Figure 5B:
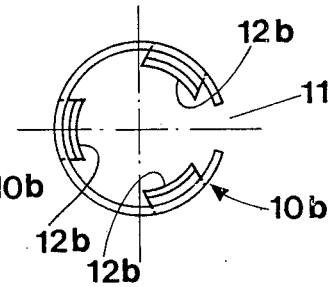
FIG. 5B shows an end view of the clip according to FIG. 5A.

The embodiment disclosed in FIGS. 5 and 6 refers to a sleeve-shaped clip 10*b* having inwardly bent tongues being located at about half the height of the clip 10*b* in axial direction. As is apparent from FIG. 6 the groove 17*b* is located at about half the height of the shaft 14 in its axial direction.

The advantage of this embodiment is that the tongues 12*b* and the groove 17*b* are located in the area that has the lowest stress when the tool is subjected to a lateral load. This facilitates the rotation of the shaft 14 of the tool 13 relative to the clip 10*b*.

In similarity to the embodiment of FIGS. 1 and 2 the clip 10*b* extends along the entire length of the shaft 14. In order to prevent penetration of dirt and other particles between the shaft 14 and the holder 16, said holder 16 is likewise provided with a projection 22 that cooperates with a groove 23 of the flange 18.

Figure 7:
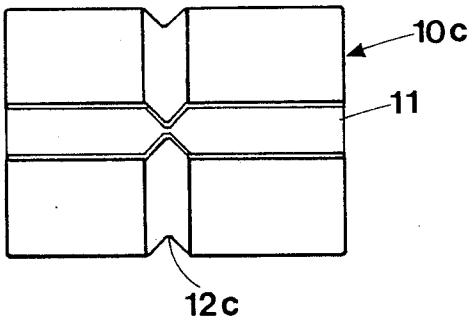
FIG. 7 shows still a further alternative embodiment of a clip according to the invention.
Figure 8:
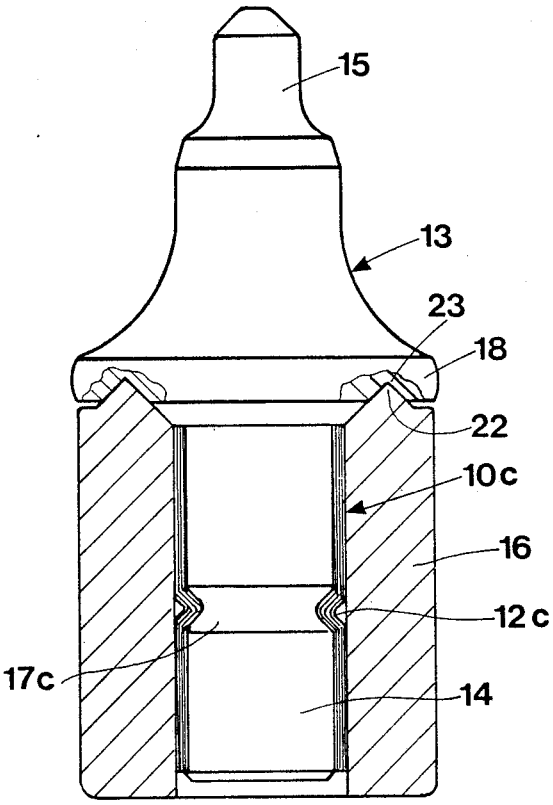
FIG. 8 shows the clip according to FIG. 7 in a mounted position.

The embodiment according to FIGS. 7 and 8 refers to a clip 10*c* that has a generally cylindrical shape and a slot 11 that extends along the entire length of the clip 10*c*. This embodiment corresponds to the embodiment according to FIGS. 5 and 6 with the difference that instead of stamped tongues the engagement means consist of a tangentially extending corrugation 12*c* that has been manufactured through roll forming of a sheet that afterwards has been bent to cylindrical shape and then hardened to get the resilient characteristics.

Figure 9:
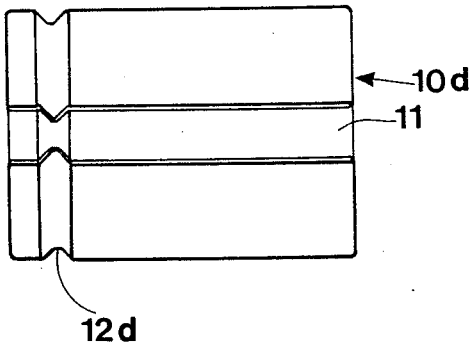
FIG. 9 shows still a further alternative embodiment of a clip according to the invention.
Figure 10:
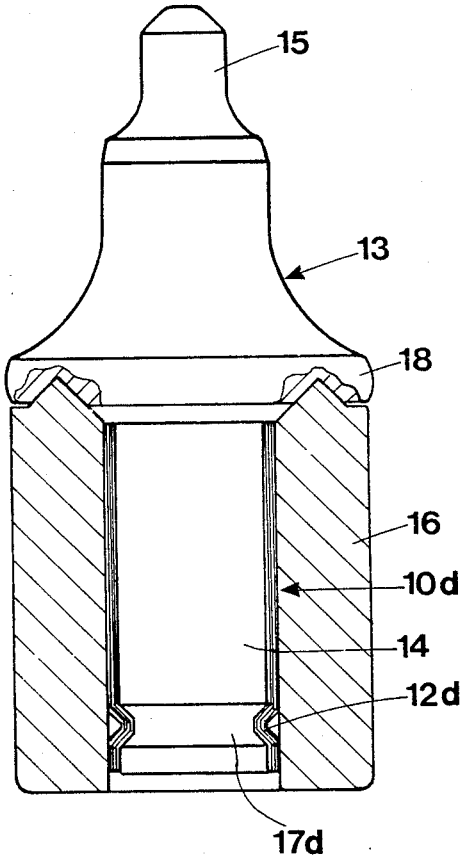
FIG. 10 shows the clip according to FIG. 9 in a mounted position.

The embodiment of FIGS. 9 and 10 refers to a clip 10*d* having engagement means in the shape of a corrugation 12*d*. This corrugation 12*d* extends in tangential direction and is located in the area of one end of the clip 10*d*. In similarity to all of the embodiments the clip 10*d* is provided with an axially extending slot 11, that runs along the entire length of the clip 10*d*.

The corrugation 12*d* cooperates with a groove 17*d* on the shaft 14 of the tool 13.

For all the embodiments described above the shaft 14 has essentially the same diameter on both sides of the groove 17; 17*a*; 17*b*; 17*c*; 17*d*.

Each of the grooves 17–17*d* has a relatively small extension in the axial direction. This is favorable especially when manufacturing the shaft of the tool by cold forming.

For all of the embodiments the portion of the clip that surrounds the shaft 14 has a generally cylindrical shape and the clip itself has some kind of engagement means, e.g. tongues, a bent end portion, a corrugation. The clip extends preferably along the entire length of the shaft 14 or at least along a major portion of the length of the shaft 14.

In the embodiments a straight axial slot has been disclosed. However, also other types of slots, e.g. such as providing a cooperating tongue and recess in the clip, are within the idea of the invention.

It should also be pointed out that the characterizing features of the different embodiments can be combined with each other. Thus, the embodiments according to FIGS 1, 2; 5, 6; 7, 8 or 9, 10 can be provided with a collar 20 according to the embodiment of FIGS. 3, 4.

The invention is thus in no way restricted to the embodiments described above but can be freely varied within the scope of the appending claims.

We claim:

1. A tool for breaking, cutting and working solid materials, comprising:

a body including:

a hard material cutting insert disposed at a front end of said body, and a longitudinally rearwardly extending shaft disposed at a rear end of said body, said shaft being of generally cylindrical shape and including an annular groove disposed in an outer periphery of said shaft adjacent a rearmost end thereof, portions of said outer periphery located longitudinally in front of and behind said groove being of substantially equal diameter, and a generally cylindrical clip mounted on said outer periphery of said shaft for retaining the tool within a holder, said clip including a slot extending longitudinally completely therethrough, said clip extending around said portion of said outer periphery disposed in front of said groove, a rear free end of said clip being inwardly bent into said groove to oppose longitudinal forward movement of said shaft relative to said clip.

2. A tool according to claim 1, wherein said clip extends along substantially the entire longitudinal length of said shaft disposed in front of said groove.

3. A tool according to claim 1, wherein said bent rear free end of said clip is of rearwardly tapering frustoconical configuration.

4. A tool according to claim 2, wherein said clip extends along substantially the entire longitudinal length of said shaft disposed in front of said groove.

5. A tool according to claim 4, wherein a front end of said clip is in the form of a forwardly expanding frustoconical collar.

6. A tool according to claim 1, wherein a front end of said clip is in the form of a forwardly expanding, frustoconical collar.

* * * * *